US006561116B2

(12) United States Patent
Linjawi

(10) Patent No.: US 6,561,116 B2
(45) Date of Patent: May 13, 2003

(54) TOWABLE SUB-AQUA DEVICE

(76) Inventor: Kareem O. Linjawi, POB 11232, Jeddah (SA)

( * ) Notice: Subject to any disclaimer, the term of this patent is extended or adjusted under 35 U.S.C. 154(b) by 0 days.

(21) Appl. No.: 09/843,667

(22) Filed: Apr. 26, 2001

(65) Prior Publication Data

US 2002/0157592 A1 Oct. 31, 2002

(51) Int. Cl.[7] ..... B63C 11/46
(52) U.S. Cl. ..... 114/315; 114/245
(58) Field of Search ..... 114/244, 245, 114/315

(56) References Cited

U.S. PATENT DOCUMENTS

| | | | | |
|---|---|---|---|---|
| 2,948,251 A | | 8/1960 | Replogle | |
| 3,084,653 A | * | 4/1963 | Lepine et al. | 114/315 |
| 3,107,640 A | * | 10/1963 | Lepine et al. | 114/315 |
| 3,120,208 A | | 2/1964 | Lawrie | |
| 3,261,318 A | | 7/1966 | Jones et al. | |
| D211,294 S | | 6/1968 | Loeffler | |
| 3,548,771 A | * | 12/1970 | Hastings | 114/315 |
| 3,638,598 A | | 2/1972 | Vlad | |
| 3,931,777 A | | 1/1976 | Colgan | |
| 3,978,813 A | | 9/1976 | Pickens et al. | |
| 4,149,483 A | | 4/1979 | Scott | |
| 4,207,829 A | | 6/1980 | Meister et al. | |
| 4,624,207 A | | 11/1986 | King | |
| 5,178,090 A | | 1/1993 | Carter | |
| 5,655,939 A | | 8/1997 | Garrido Salvadores | |

* cited by examiner

*Primary Examiner*—Ed Swinehart
(74) *Attorney, Agent, or Firm*—Richard K. Robinson

(57) ABSTRACT

There is disclosed an improved sub-aqua device suitable for towing a person through the water. Specifically there is disclosed a sub-aqua device including: a support member; a pair of manoeuvring planes for manoeuvring the device, each defining an elevation plane; and a means for controlling each manoeuvring plane including a handle, each handle extending in a plane coincident with the respective elevation plane.

8 Claims, 2 Drawing Sheets

TOWABLE SUB-AQUA DEVICE

TECHNICAL FIELD OF THE INVENTION

The present invention relates to a towable sub-aqua device of the type suitable for being steered by an individual being dragged by the towing device.

BACKGROUND OF THE INVENTION

Towable sub-aqua devices are known for both leisure and professional purposes. Such devices generally have various disadvantages associated therewith. For example such devices are either complex and/or expensive to manufacture, difficult and/or cumbersome to transport and store, or complicated to use. Examples of such known devices are described below.

U.S. Pat. No. 3,931,777 discloses an aqua sled for carrying people on and under water comprises a frame of aluminum tubing having a rigid planar section of transparent material to enable users to see beneath the sled and buoyant material affixed thereto to float the sled. A pair of sheets of rigid transparent material are affixed to the front of the frame and form a dihedral of approximately 90° with each other. Each of the sheets extends at an angle of approximately 45° with a corresponding side of the planar section of transparent material. A control device is affixed to the frame and is manually controllable to control the movement of the sled.

U.S. Pat. No. 4,149,483 discloses a device to be towed through the water by a boat and which in turn is adapted to tow a person through the water, the body of the device having a constant buoyancy and being equipped with steering means whereby it can be maintained on the surface of the water while being towed, can be submerged while towing a person with scuba gear, and which can be maneuvered under water to partially or completely roll the device and its user.

U.S. Pat. No. 4,207,829 discloses a towable, swimmer-controlled, aquatic plane device that includes an elongated wing element having sections symmetrical about a transverse center line and a fin element also having sections symmetrical about a transverse center line, the fin element being removably attached at its transverse center line to the wing element at its transverse center line with the fin element sections extending vertically above and below the wing element. Openings are provided in each fin element section adjacent its leading edge and adjacent the wing element for attaching a tow rope. Openings are provided in each fin element adjacent its trailing edge which form hand grip portions by which a swimmer can steer the device in any one or more of four directions, i.e., down for diving, up to plane on the surface of the water, or banking for turning left or right.

U.S. Pat. No. 5,178,090 discloses an underwater diving plane that has a main frame forming an isosceles triangle, having a base part, two side legs of equal length and an apex; a detachable transverse axle which is pivotally connected to the main frame, having two ends and two main planes each fixedly attached to the axle; a fore plane attached to the frame proximal to the apex; and a tow force transition cable to allow the planes stable planning action.

U.S. Pat. No. 5,655,939 discloses a rudder comprised of a planar body wherein a large front notch and a rear notch form two lobes or side wings which are perfectly symmetric with respect to the front-to-rear axis. On the axis and at the vicinity of the front notch is provided the unique point of towing, variable through a movable part, to which is fixed the corresponding towing rope. On each side wing, there are arranged, symmetrically and forward of the towing point, two windows that the user can grip with his or her hands and, behind the windows, in the lower part of the device and also in a symmetrical arrangement there are provided two rudder-like fins. The apparatus can be gripped manually with the arms extended forward allowing a swimmer-diver to move on the water or in the water.

All of these known devices have various ones or all of the known disadvantages stated hereinabove.

It is an aim of the present invention to provide an improved sub-aqua device, suitable for towing a person through the water. In particular it is an aim of the present invention to provide a sub-aqua device in which manoeuvrability is improved over known prior art devices.

SUMMARY OF THE INVENTION

The invention provides a device that is simple and inexpensive to manufactured. In particular the device is easy to use. The device is of a relatively small size, and easily transportable and readily stored. As such the relatively inexpensive cost of the device and its ease of use results in an increased activity of sub-aqua exploration, particularly in relation to leisure activity.

The structure of the plane mechanism of the device, provides significantly improved stability and manoeuvrability over previously known devices. The independent nature of the two parts of the plane mechanism, provides increased manoeuvrability of the device without any increase in the complexity of the device.

In accordance with a first aspect of the present invention there is provided a sub-aqua device including: a means for towing the device; a pair of planes for manoeuvring the device, each defining a depth plane; and a means for controlling each plane means including a handle, with each handle extending in a plane coincident with the respective manoeuvring plane.

In accordance with a second aspect of the present invention there is provided a sub aqua device including: a bar for towing the device; a pair of plane members for manoeuvring the device, each defining a manoeuvring plane; and a manoeuvring plane rod for controlling each plane member including a handle, each handle extending in a plane coincident with the respective manoeuvring plane.

In accordance with a third aspect of the present invention there is provided a sub-aqua device including: a means for towing the device; a pair of manoeuvring plane means for manoeuvring the device; and a means for controlling each manoeuvring plane means, wherein the means for towing the device comprises a bar extending between the respective manoeuvring plane means.

In accordance with a fourth aspect of the present invention there is provided a sub-aqua device including: a bar for towing the device; a pair of manoeuvring plane members for manoeuvring the device; and a rod for controlling each manoeuvring plane member, wherein the bar for towing the device extends between the respective manoeuvring plane means.

BRIEF DESCRIPTION OF THE FIGURES

The present invention will now be described by way of example with reference to the accompanying drawings in which.

DETAILED DESCRIPTION

Figure 1:
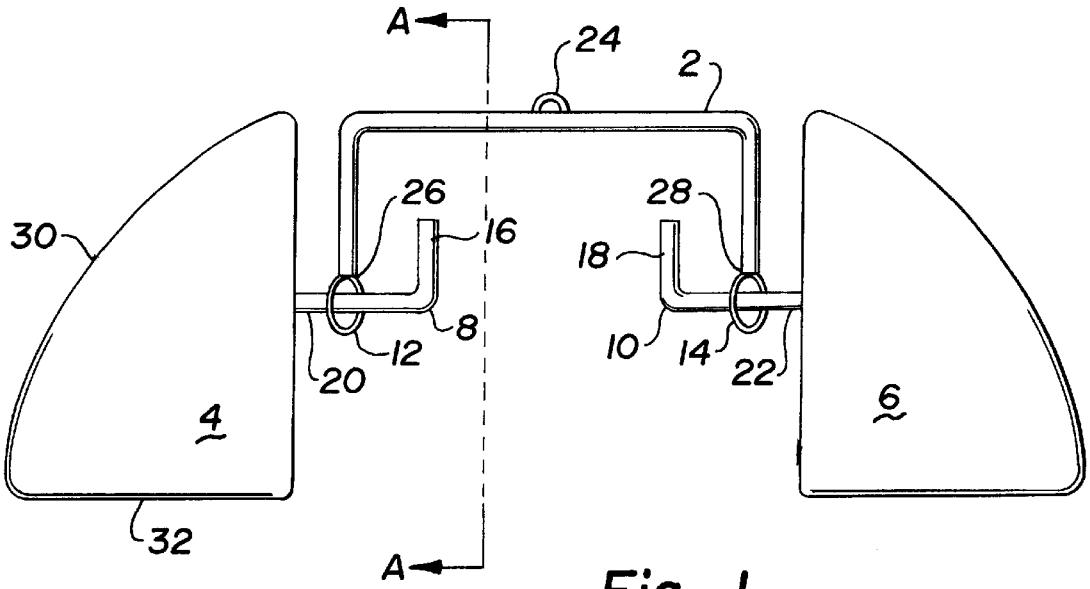
FIG. 1 illustrates a preferred embodiment of the present invention.

Referring to FIG. 1, there is shown a preferred embodiment of a sub-aqua device in accordance with the present invention. The main components of the device are: a device support member 2, a pair of manoeuvring planes 4 and 6 which are used for manoeuvring the device, and handles 8 and 10 for controlling the manoeuvring plane.

The support member 2 includes a tow hook 24. The tow hook 24 is used for attaching a towrope to the sub-aqua device. The other end of the towrope or towing device is, in use, connected to a boat or other aquatic towing means or vehicle for towing the sub-aqua device of the present invention through or under the water.

Each of the planes 4 and 6, or plane, comprises a handle for manoeuvring the sub-aqua device. The planes 4 and 6 each comprise a water foil having a wing or fin type shape. The structures in the preferred embodiment of the invention are made of hard rubber, plastic, wood or metal. In general, the shape of the planes 4 and 6 is that of a water foil having a pair of opposing surfaces for offering resistance to the water through which the sub-aqua device is towed. A description of the operation of the planes 4 and 6 means utilising the opposing surfaces is given in further detail herein below.

Each of the planes 4 and 6 has affixed thereto a respective means for positioning each plane, or manoeuvring handles 8 and 10. The manoeuvring handles 8 and 10 includes a port griping handle 16, and a starboard gripping handle 18 having a retention portion, respectively identified as 20 and 22.

The respective retention portions 20 and 22 are attached to the respective manoeuvring planes 4 and 6. The support member 2 is provided at distal ends thereof with rings 12 and 14 for connecting to the respective retention portion of each handle. Thus a ring 12 is provided for connecting the distal end 26 of the support member 2 to the retention portion 20, and a ring 14 is provided for connecting the distal end 28 of the support member 2 to the retention portion 22.

The rings 12 and 14 are such that the retention portions 20 and 22 are rotatably mounted within the rings 12 and 14. The rings 12 and 14 are fixably connected to the distal ends 26 and 28 of the support member 2.

As the retention portions 20 and 22 are fixably connected to the manoeuvring planes 4 and 6, as the retention portions 20 and 22 rotate about the rings 12 and 14 the manoeuvring planes 4 and 6 similarly rotate.

The rotation of the retention portions 20 and 22 is controlled, in use, by the gripping handles 16 and 18 of the gripping handles 8 and 10. As the handles are turned, the retention portions turn and consequently the manoeuvring planes 4 and 6 rotate. As can be understood by reference to FIG. 1, if the handle 16 is rotated such that it moves upwards relative to the page, the manoeuvring plane rotates such that the front edge 30 of such rises and the rear edge 32 falls. This is exemplified by the cross-section, through A—A, shown in FIG. 2.

As can be further understood by reference to FIG. 1, if the handle 16 is rotated such that it moves downwards relative to the page, the manoeuvring plane means rotates such that the front edge 30 of such falls and the rear edge 32 rises. This is exemplified by the cross-section, through A—A, shown in FIG. 3.

It will be understood that the same manoeuvring plane control applies to the manoeuvring plane 6.

Figure 2:
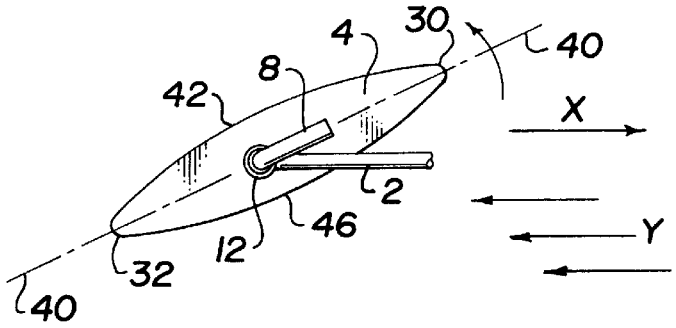
FIG. 2 illustrates a first illustrative cross-section through A—A of FIG. 1.
Figure 3:
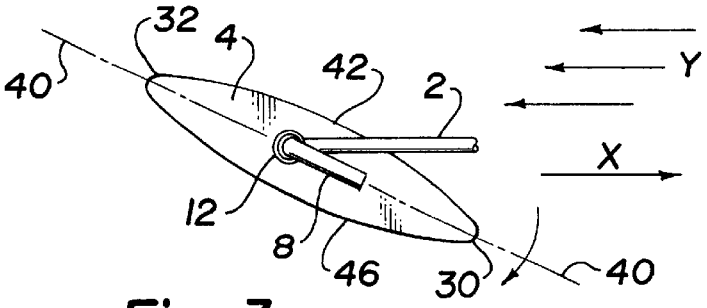
FIG. 3 illustrates a second illustrative cross-section through A—A of FIG. 1.

Referring to FIGS. 2 and 3, the dashed lines 40 represent the depth plane of the manoeuvring plane 4. That is to say, the dashed line 40 represents the direction in respect of which the user of the sub-aqua device is manoeuvring the device.

It is significant to note, referring to FIG. 3, that the rod 8 remains in a plane coincident with the depth plane at all times. As such, the handle is positioned at all times to minimise water resistance, since it always points in the direction in which the user is manoeuvring the device.

It should be also noted that the arrangement of the invention as shown in FIG. 1 enables the two manoeuvring plane 4 and 6 to be manipulated independently. As will be described further hereinafter this provides a significant degree of improved manoeuvrability Referring again to FIGS. 2 and 3, it can be seen that as the manoeuvring plane is rotated either a top surface 42 (FIG. 3) or a bottom surface 44 (FIG. 2) of the manoeuvring plane provides a resistance surface to the water. The arrow X represents the direction of the movement of the sub-aqua device 100 through the water, and the arrows Y represent the flow of water against the resistance surface. It is obvious that the speed of the device through the water is dependent on the strength of the user's arms. However, for the average adult user, being towed at 5 mph will provide a unique and enjoyable experience and should be well within the strength requirements, As one skilled in the art will understand, the flow of water against a surface of the manoeuvring plane, assisted by the hydrodynamic design of the manoeuvring plane, will cause the manoeuvring plane to move in a particular direction, either up or down. In the position shown in FIG. 2, the sub-aqua device will move in an upwards direction, whilst in the position shown in FIG. 3 the sub-aqua device will move in a downwards direction.

As a consequence of the independent manoeuvring plane mechanism provided by the sub-aqua device of the present invention, one manoeuvring plane device may be steered upwards whilst the other is steered downwards. This enables more complex manoeuvring to be performed other than simple, up or down manoeuvres but also banking manoeuvres.

Once again it is worth emphasising that a significant advantage of the present invention is provided by the fact that the gripping portions or handles 16 and 18 extend in a direction perpendicular to the flexing portion 20 and 22 and parallel to the manoeuvring planes 4 and 6. As such, in use, the handles 16 and 18 offer minimum resistance to the water flow and minimum interference with manoeuvring. FIGS. 2 and 3 particularly demonstrate this. As such the handles 16 and 18 offer minimum resistance to the water flow by always pointing in the direction in which the manoeuvring plane mechanism is positioned. Even in use, with the user's hands gripping the gripping handles 16 and 18, resistance to the water flow, and hence interference with the manoeuvring plane mechanism is minimised.

It is important that the manoeuvring is controlled by the manoeuvring planes 4 and 6, and the effects of any other aspects of the design of the sub-aqua device on the manoeuvring be minimised. The arrangement of the handles 16 and 18 in accordance with the present invention provides this.

The attachment of the support member 2 to gripping handles 8 and 10 is provided by various techniques know in the art and will be apparent to one skilled in the art. Nevertheless, two techniques for achieving the attachment are discussed below.

Figure 4:
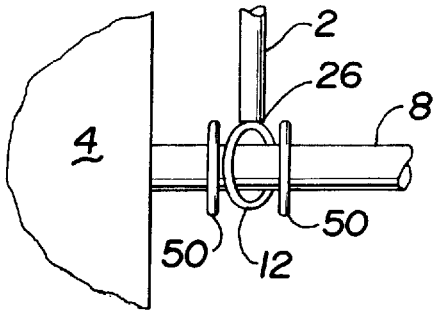
FIG. 4 illustrates a first modification to the embodiment of FIG. 1.
Figure 5:
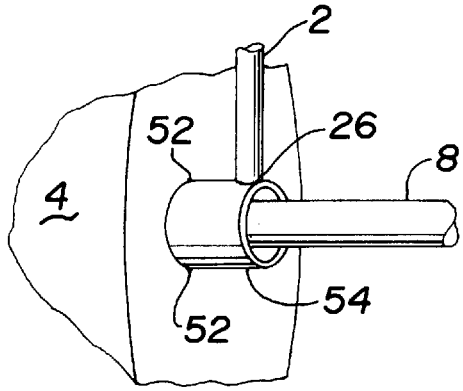
FIG. 5 illustrates a second modification to the embodiment of FIG. 1.

FIGS. 4 and 5 illustrate a close-up perspective of two embodiments of the arrangement for connecting the support member 2, the manoeuvring planes 4 and 6, and the gripping handles 8 and 10.

Referring to FIG. 4, in a first embodiment the ring 12 connects the support member 2 to the handle 8 is located between two blocks 50 which are rigidly connected to the handle 8. The blocks 50 operate to fix the location of the rings 12 relative to the handle 8, thereby creating a stable structure, whilst still enabling the handle 8 to rotate relative to the ring 12.

Referring to FIG. 5, in a second embodiment the means 12 is adapted to form a cylindrical device 54 that extends along the axis of the retention portion 20 of the handle 8 to connect with the side surface of the manoeuvring plane 4 at points 52. In this embodiment the cylindrical device 54 is fixed at points 52 in a rotatable manner, such that the manoeuvring plane 4 still rotates relative to the cylindrical means responsive to rotation of the handle.

It should be appreciated that the examples shown in FIG. 4 and 5 are only illustrative examples, and the present invention is in no way limited thereby.

Figure 6:
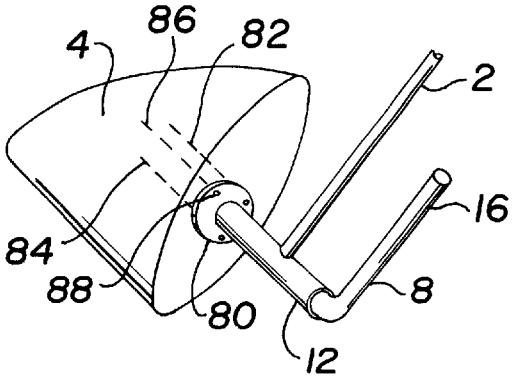
FIG. 6 illustrates a third modification to the embodiment of FIG. 1.

Referring to FIG. 6, the miunting of the plane 4 to the handle 16 is shown. Mating flange 80 is welded to end of handle 16 and connected to a matching flange on the plane 4 by fastner 88. If the plane is made of metal or wood then the mating flange may be directly attached to the plane 4, If however, the plane is made of a molded plastic or other synthetic material then gripping rods 82, 84, & 86 will have threaded ends and be positioned to mate with the flange 80. In this embodiment the fastner 88 will connect to both flange 81 and the plane 4. A similar connection is provided for plane 6.

What is claimed is:

1. A sub-aqua device including:

a support member having first and second distal ends;

first and second maneuvering planes, each defining an elevation plane and each having an axis of rotation and a front edge and an inside edge opposite the front edge;

first and second handles, each handle having a gripping section and a retention section with the gripping section being perpendicular to the retention section and the retention section of the first handle being connected to the first maneuvering plane on the inside edge at the axis of rotation and the retention section of the second handle being connected to the second maneuvering plane on the inside edge at the axis of rotation with the gripping section of the first handle being extended in a plane coincident with the elevation plane of the first maneuvering plane and the gripping section of the second handle being extended in a plane coincident with the elevation plane of the second maneuvering plane; and the first distal end being rotatably mounted to the retention section of the first handle and the second distal end being rotatably mounted to the retention section of the second handle; the first handle being independent of and directly unconnected to the second handle and the second handle being independent of and directly unconnected to the first handle.

2. The sub-aqua device according to claim 1 wherein each handle comprises a rod-like structure.

3. The sub-aqua device according to claim 1, wherein in use each maneuvering plane is controlled by moving the respective handle.

4. The sub-aqua device according to claim 1, wherein the support member comprises a bar extending between the first and second manoeuvring planes.

5. The sub-aqua device according to claim 1, wherein the support member comprises a U-shaped bar.

6. The sub-aqua device according to claim 1, wherein the support member further includes a tow hook.

7. The sub-aqua device according to claim 6, wherein in use the tow hook is connectable to a towing vehicle by a tow line.

8. A sub-aqua device including:

a formed bar having a pair of parallel extensions and a connecting member having one of the pair of parallel extensions formed on each end, each of the parallel extensions being perpendicular to the connecting member and each of the parallel extensions having an end opposite the connecting member;

first and second planes for manoeuvring the sub-aqua device, each of the first and second planes defining an elevation plane; and first and second manoeuvring rods for controlling each plane including a handle and a retention section in perpendicular arrangement with the handle, the first handle extending in a plane coincident with the elevation of the first plane and the second handle extending in a plane coincident with the elevation of the second plane; and the retention section of the first manoeuvring rod being mounted to the first plane and rotatably connected to the end of the first extension and the retention section of the second maneuvering rod being mounted to the second plane and rotatably connected to the end of the second extension; the first manoeuvring rod being independent of and directly unconnected to the second manoeuvring rod and the second manoeuvring rod being independent of and directly unconnected to the first manoeuvring rod.

* * * * *